US006345687B1

(12) United States Patent
Thorpe

(10) Patent No.: US 6,345,687 B1
(45) Date of Patent: Feb. 12, 2002

(54) TUBE END CLOSURE

(76) Inventor: Denis Thorpe, Lot 3, Jalan Perugahaan 4, Kawasan, Perindustrian Beranang (MY)

( * ) Notice: Subject to any disclaimer, the term of this patent is extended or adjusted under 35 U.S.C. 154(b) by 0 days.

(21) Appl. No.: 09/445,744

(22) PCT Filed: Jun. 5, 1998

(86) PCT No.: PCT/NZ98/00078

§ 371 Date: Mar. 6, 2000

§ 102(e) Date: Mar. 6, 2000

(87) PCT Pub. No.: WO98/58165

PCT Pub. Date: Dec. 23, 1998

(30) Foreign Application Priority Data

Jun. 16, 1997 (NZ) ..... 328099

(51) Int. Cl.[7] ..... F01N 7/18
(52) U.S. Cl. ..... 181/243; 285/921
(58) Field of Search ..... 181/269, 272, 181/243, 282; 285/222, 405, 921; 29/505–509, 522.1, 524

(56) References Cited

U.S. PATENT DOCUMENTS 4,192,403 A * 3/1980 Nakagawa et al. ..... 181/272
4,212,099 A * 7/1980 Williams et al. ..... 29/507
4,576,247 A * 3/1986 Thorpe ..... 181/243
5,559,308 A * 9/1996 Hayashi ..... 181/272

FOREIGN PATENT DOCUMENTS

| | | |
|---|---|---|
| DE | 3621465 | 1/1988 |
| DE | 4017748 | 12/1991 |
| EP | 0067246 | 12/1982 |
| EP | 0072886 | 3/1983 |
| GB | 2010389 | 6/1979 |
| GB | 1166410 | 5/1986 |

OTHER PUBLICATIONS

Derwent Abstract Accession No. 84–182768/29, class P52 ZA 8307–109A (Dev Finanace Corp. NZ) Mar. 30, 1984.

* cited by examiner

*Primary Examiner*—Khanh Dang

(57) ABSTRACT

An end (29) of a tube (25) is closed off by a disk (31) which is locked in position in a joint formed with a collar (27) and a plate surround (28). The collar (27) includes a flange (26) which is secured against the lower face of the plate surround (28). The flange (26) may include ribs which act as torsion resistance ribs enhancing the engagement with the plate surround (28). In another embodiment, the collar (27) forms a tube end joint but not a closure.

7 Claims, 7 Drawing Sheets

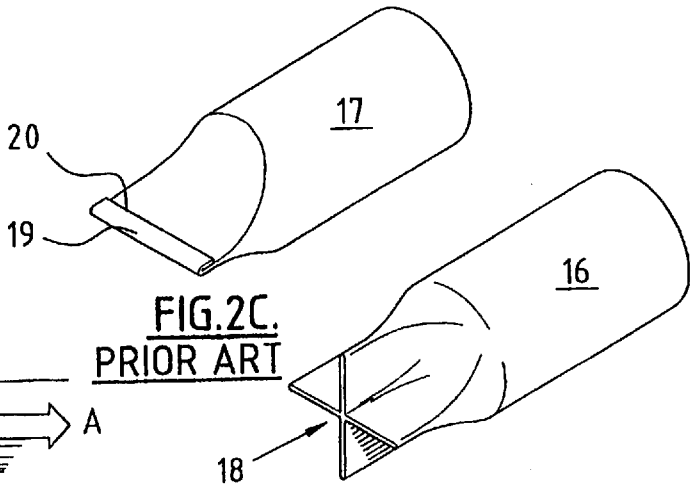
FIG.2C.
PRIOR ART
FIG.2B.
PRIOR ART
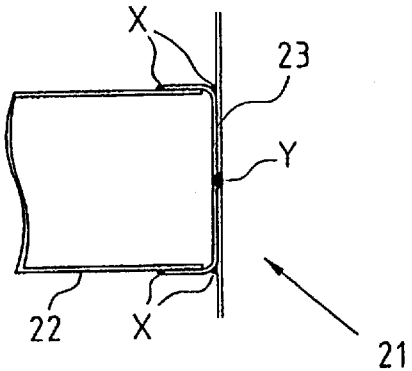
FIG.2D.
PRIOR ART
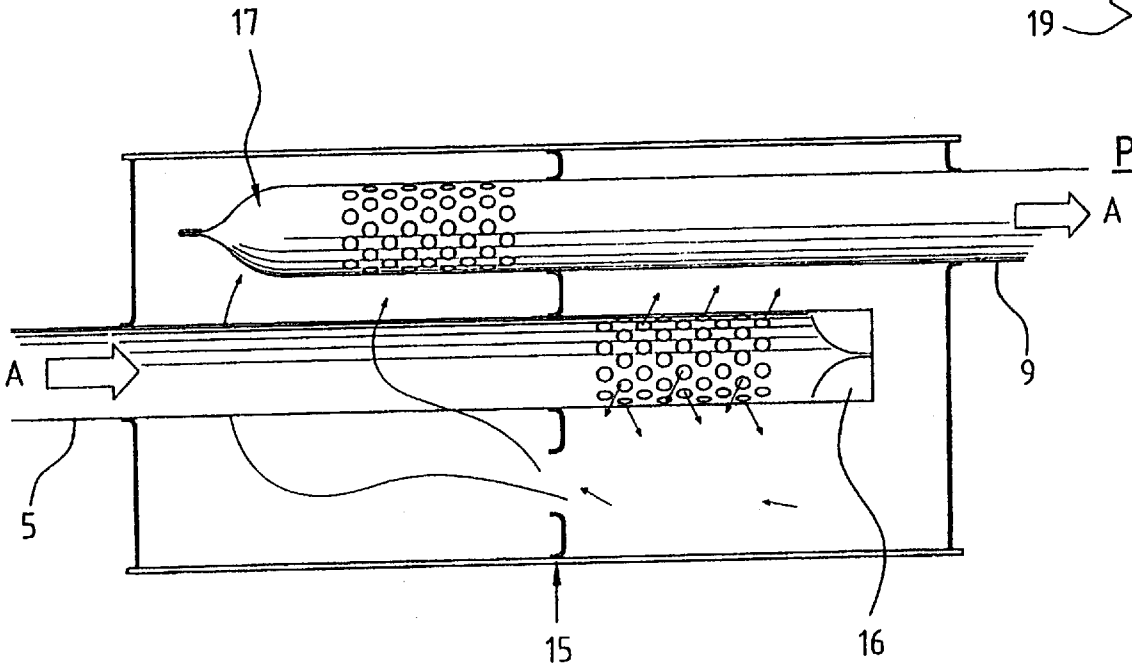
FIG.2A.
PRIOR ART

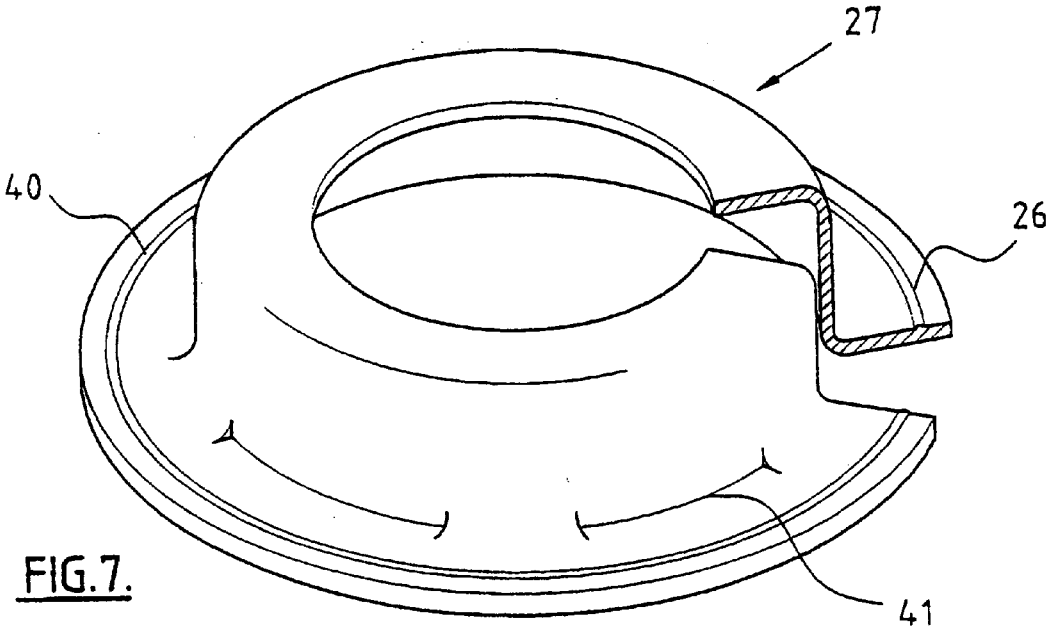
FIG.7.
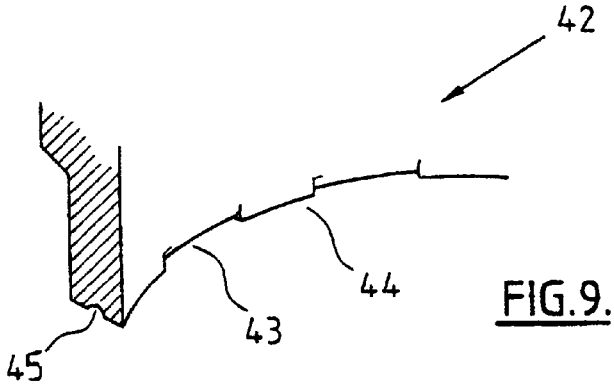
FIG.9.
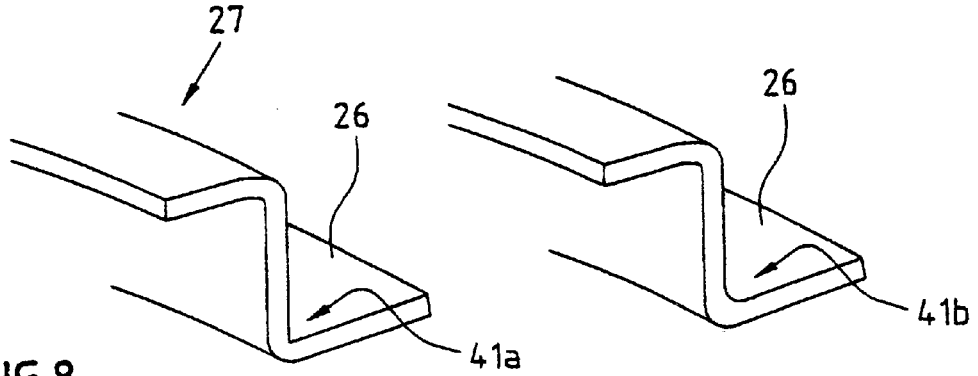
FIG.8. (a)
FIG.8. (b)

TUBE END CLOSURE

BACKGROUND OF THE INVENTION

The present invention relates to a tube end closure and a method and apparatus for forming same.

The present invention has particular application in the construction of exhaust mufflers for vehicles and for simplicity only, will be described particularly in respect of that application. However, it will be appreciated by those skilled in the engineering arts that the present invention in its various aspects can find application in numerous other uses and whenever a tube end closure is required to be effected.

Muffler assemblies for the exhaust systems of vehicles predominantly require extensive welding between the tubes and battles and, as is well recognised, the use of welding is time consuming and expensive and can provide major problems if a high quality weld is not obtained, and even if it is, a failure of a weld can require an expensive replacement of an entire silencer. There is also the tendency for corrosion to develop around the weld points.

In order to overcome those problems previous proposals have included non-welded joints in the muffler assembly.

The present invention in its preferred embodiments relates to a non-welded joint and/or tube end closure which, utilising a collar, can provide a substantially leak-free, torque resistant, inside to outside interface joint, suitable for use in a muffler assembly or the like.

OBJECTS OF THE INVENTION

It is, thus, an object of a preferred embodiment of the present invention to provide a tube end closure or joint and/or apparatus or a method for forming same, which will overcome or at least obviate problems in tube and closure/jointing techniques available to the present time, or which at least will provide a public with a useful choice.

A further object of another embodiment of the invention is to provide a collar for use in providing a tube end closure or joint.

Further objects of this invention will become apparent from the following description.

BRIEF SUMMARY OF THE INVENTION

According to one aspect of the present invention, there is provided a tube end closure including a collar member which secures a free end of a tube within an aperture in a plate member and a closure means which is secured between an inner edge of said collar member and said free end of said tube in closing off said free end of said tube.

According to a further aspect of the present invention, a tube end closure as defined in the paragraph immediately above has said closure means in the form of a disk, a peripheral edge of which has been forced into engagement between a peripheral edge of said collar and a rim formed at said free end of said tube.

According to a further aspect of the present invention, a tube end closure as defined in the paragraph immediately above, has said disk member with a convex surface extending away from said free end of said tube.

According to a further aspect of the present invention, a tube end closure as defined in the paragraph immediately above, includes an outer flange of said collar member which engages beneath a lower surface of said plate about said aperture.

According to a further aspect of the present invention, a tube end closure as defined in the paragraph immediately above, has said flange with at least one sealing and/or anti torsion rib.

According to a still further aspect of the present invention, a tube end closure is provided substantially as herein described, with reference to any one of the embodiments of the invention, as shown in FIGS. 3 and 4 of the accompanying drawings.

According to yet a still further aspect of the present invention, a muffler assembly includes at least one tube end closure, as defined in any one of the six immediately preceding paragraphs.

According a still further aspect of the present invention, a method of forming a tube end closure comprises the steps of securing a collar member within an aperture provided in a plate member, and with a free end of a tube extending through said aperture, and further provides for the securement of a closure means within said free end of said tube end between said collar member and said free end.

According to a further aspect of the present invention, a method of forming a tube end closure is substantially as herein described and/or with reference of FIGS. 3, 4 and 5 of the accompanying drawings.

According to a still further aspect of the present invention, an apparatus for forming a tube end closure includes means for securing a collar member within a free end of a tube extending through an aperture in a plate member and means for securing a closure means within said free end and between said free end and said collar member.

According to a still further aspect of the present invention, an apparatus for forming a tube end closure, is substantially as herein described and/or with reference to FIG. 5 of the accompanying drawings.

According to a further aspect of the present invention, a tube end joint includes a collar member which receives a free end of a tube within an aperture in a plate member, an inner edge of said collar member securing said free end against a wall of said collar member, an edge of said plate member about said aperture being secured between said wall and a bottom flange of said collar.

According to a further aspect of the present invention, a collar for use in the tube end joint or closure of any of the twelve immediately preceding paragraphs includes a flange having sealing and/or torsion resisting means provided therefor.

According to a still further aspect of the present invention, a tube end joint includes a locking collar substantially as herein described and/or with reference to FIGS. 6A and 6B or FIGS. 7, 8, 10 and 11 of the accompanying drawings.

Further aspects of this invention, which should be considered in all its novel aspects, will become apparent from the following description, given by way of example, of possible embodiments of the invention and with reference to the accompanying drawings.

BRIEF DESCRIPTION OF THE DRAWINGS

FIGS. 2A, B, C, D: show additional prior art constructions;

FIG. 7: shows a part cut-away side perspective view of a collar according to a further embodiment of the invention;

FIGS. 8(*a*) & 8(*b*): show diagrammatically cross sectional views through separate portions of the collar of FIG. 7;

FIG. 9: shows a part of a coining tool in cross section (and not to scale);

DESCRIPTION OF PREFERRED EMBODIMENTS OF THE INVENTION

Figure 1:
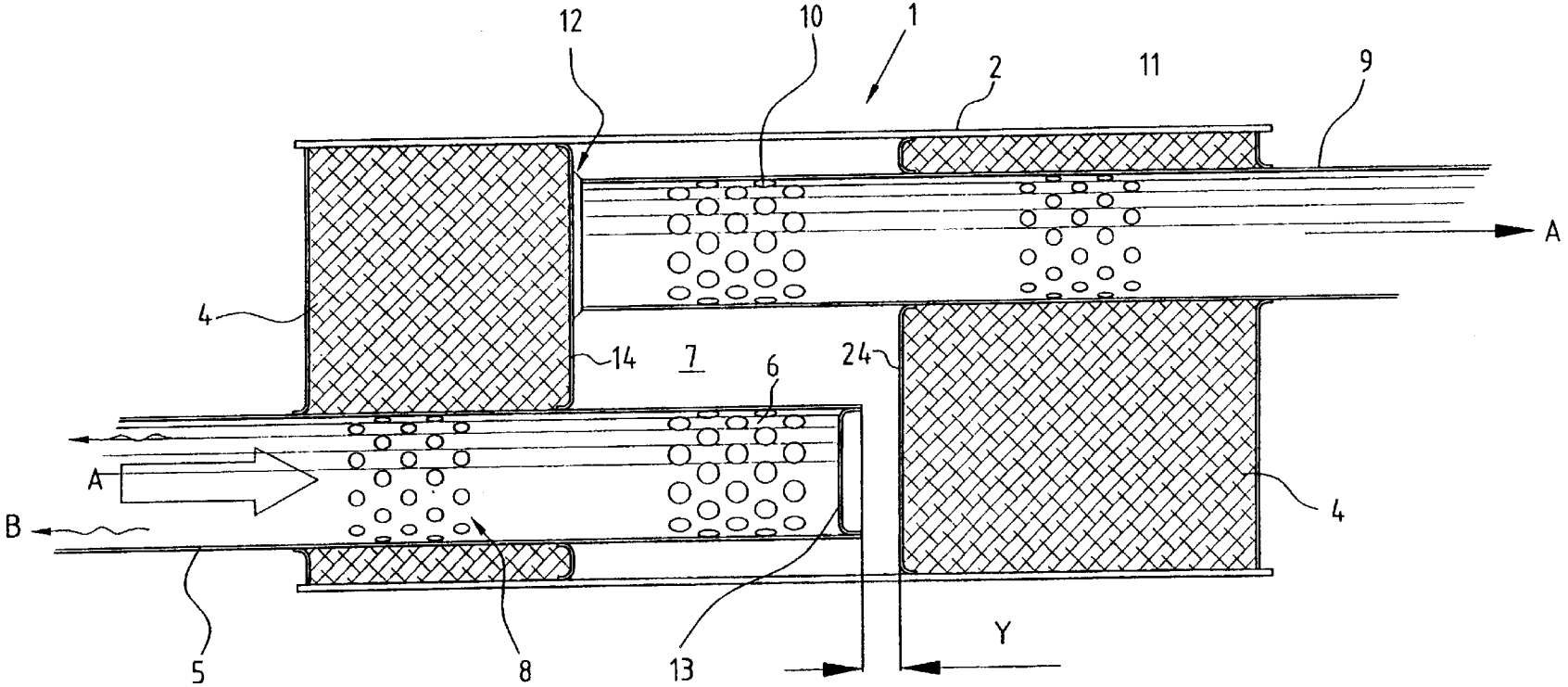
PRIOR ART FIG.1.
FIG. 1: shows very diagrammatically a prior art muffler assembly.

Dealing firstly with FIGS. 1 and 2, these show prior art constructions which may typically be used in tube closure techniques in muffler constructions particularly.

Referring to FIG. 1, a muffler assembly referenced generally by arrow 1, is shown comprising an outer housing with the gas flow indicated by arrows A and with the reverse direction shock waves indicated by the arrows B. The particular muffler construction 1 is shown using a combination of an absorption and dissipation technique with sound absorbing material 4, such as glass fibre positioned within the housing 2. The inlet tube or pipe 5 is shown closed off by a cup shaped closure 13 which would be welded to the end of the tube 5. Dissipation holes 6 are shown provided at the end of the tube 5 to provide for gas entry into the plenum chamber 7, additional louvres or perforations 8 also being indicated in the tube E. Where such a closure cup 13 is utilised, a gap "Y" is shown provided between the end of the tube 5 and the plate 24. The exit tube or pipe 9 is similarly shown with apertures 10 and louvres or perforations 11. The exhaust pipe or tube 9 will be welded at 12 to the plate 14. It is seen, therefore, that in a typical muffler assembly 1, welding is used to achieve both the mechanical join of a pipe to a plate and in providing for the closure of a tube.

Referring to FIG. 2A, another cheaper form of muffler assembly is referenced generally by arrow 15 with the gas flows between the inlet pipe 5 and exhaust pipe 9 being shown by the arrows and with two possible tube closures being referenced generally by arrows 16 and 17. The closure 16 is shown enlarged in FIG. 2B and as comprising a substantially cruciform and closure 18 which will be welded up completely at its end. In the other closure 17, see FIG. 2C, the end 19 has been folded over and then typically tack welded along the edge 20. In another typical tube closure, referenced generally by arrow 21, as shown in FIG. 2D, the tube 22 may be clamped by a drawn cup shaped closure 23 and welded at points X and/or Y.

Because of the problems with welded closures, such as those described above, the present invention has been developed in order to provide a secure, gas tight, weld free and torque resistant joint.

Figure 3:
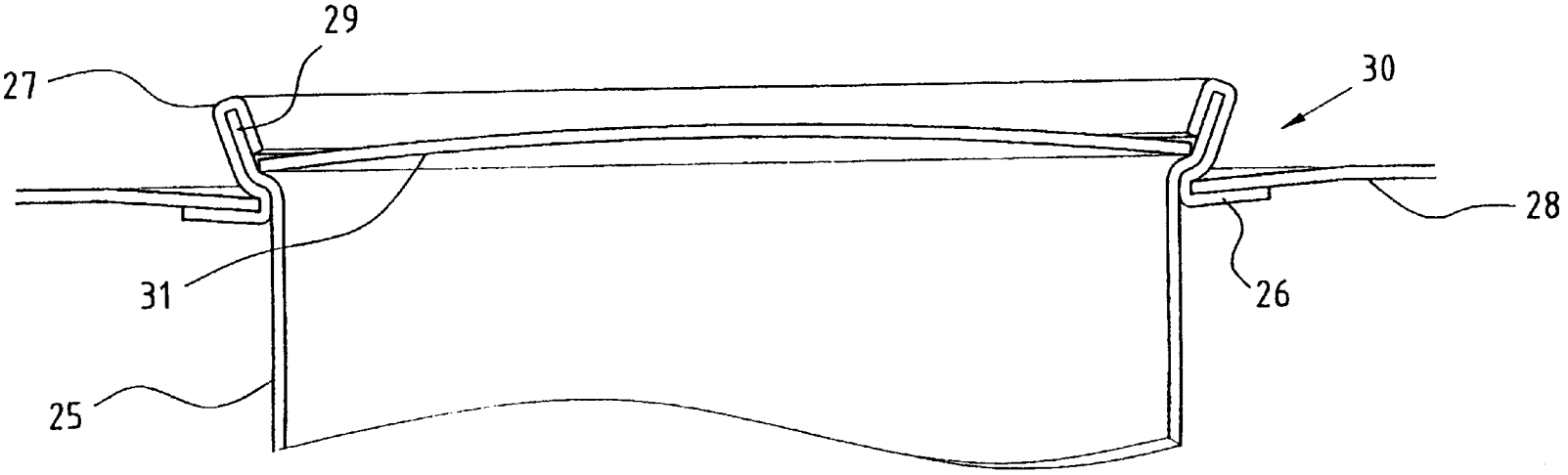
FIG. 3: shows very diagrammatically an initial stage in forming a tube end closure, according to one possible embodiment to the invention.
Figure 4:
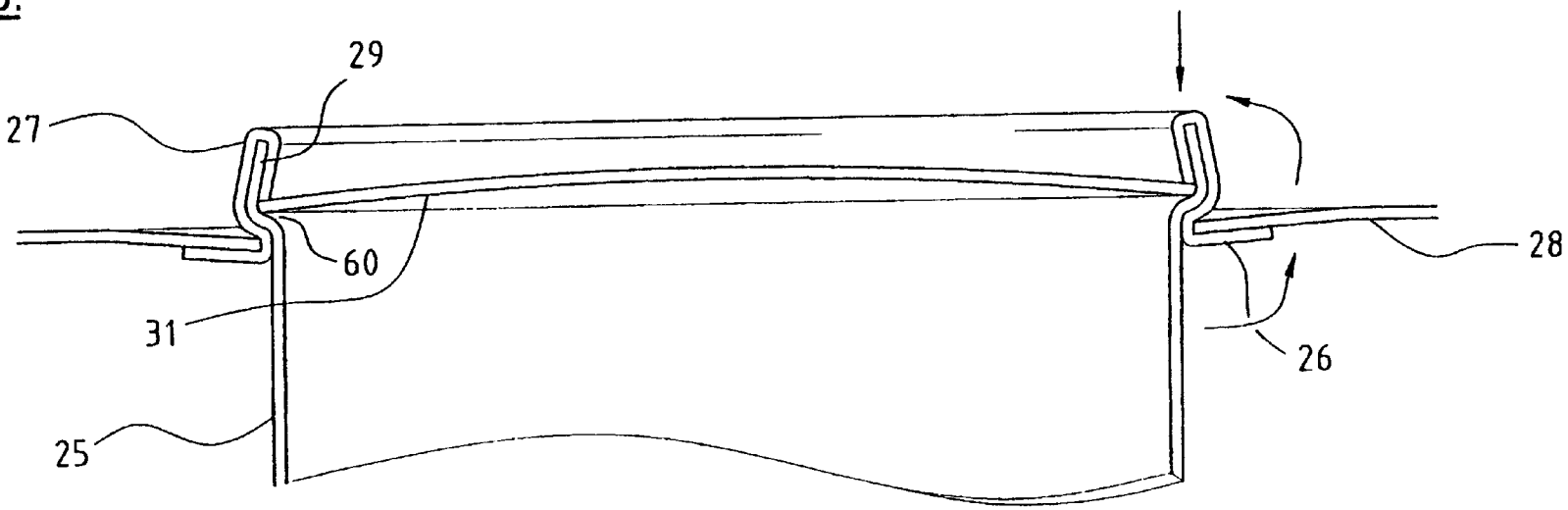
FIG. 4: shows a tube end closure, according to one possible embodiment to the invention.

Referring to FIG. 3, a tube end closure referenced generally by arrow 30, is shown being provided for the end 29 of a tube 25 which has been inserted into an aperture in plate 28. A locking collar 27 has been placed over the end 29 with a bottom flange 25 positioned beneath the plate 28. A punch has then, in its first stroke, splayed open the collar 27 and the tube end 29 enabling a closure disk 31 to be positioned as shown. A second stroke of the punch can now spread the disk 31, so that its peripheral edge extends so as to be under the bottom edge of the collar 27 when a final stroke of the punch can close the walls of the collar 27 and the tube end 29 inwardly so as to trap the peripheral edge of the disk 31 beneath the peripheral edge of the collar 27 and a rim formed at the free end 29 of the tube 25, as shown in FIG. 4. In this closing operation, the disk 31 is used as the fulcrum which acts to tighten the joint with the plate 28, as well as securing the disk 31, as indicated by the arrows in FIG. 4. In this way, a secure weld free joint can be achieved between the tube 25 and the plate 28 while, at the same time, the end 29 of the tube 25 is closed off by the disk or other closure means 31 forming part of the mechanical joint.

Figure 5:
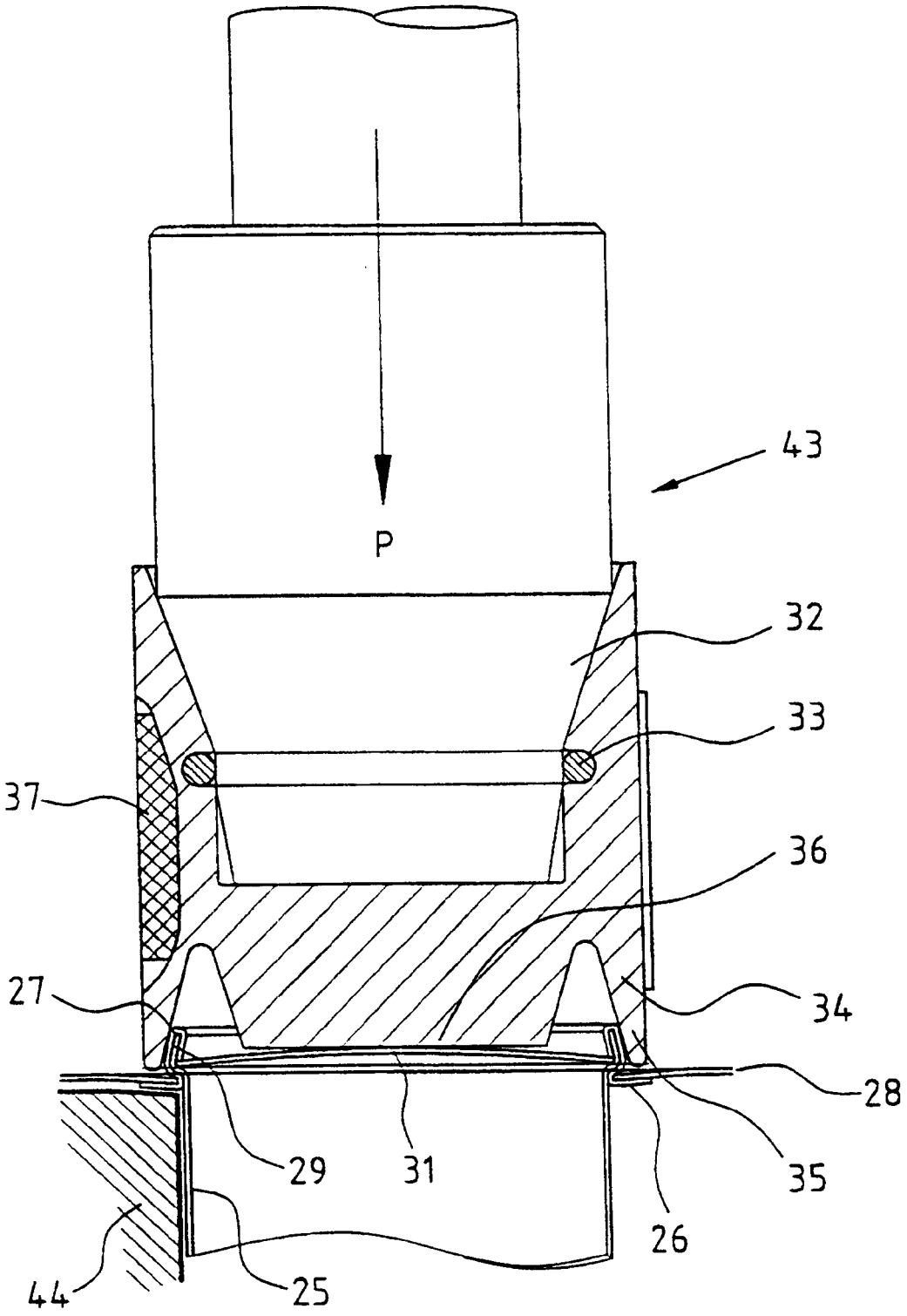
FIG. 5: shows very diagrammatically a punch assembly, according to one possible embodiment to the invention for forming a tube end closure.

In FIG. 5, a punch assembly which may be suitable for forming in the joint of FIG. 4, is referenced generally by arrows 43. The punch assembly 43 would be utilised with an anvil 44 positioned about the tube 25 and beneath the plate 28 of FIGS. 3 and 4. The punch assembly 43 as shown with a punch 32, an "O" ring 33 and a closing "chuck" 34 with a bevelled edge 35 which will act so as to provide the inward movement of the collar 27 in the closing operation. In operation, the punch 32 would on the first stroke splay the collar 27. The disc 31 would then be inserted and the chuck 34 with its nose 36 applied. The second stroke will now compress and expand the disc 31 as the walls of the collar 27 are closed inwards to form the joint, spreading the components into the position shown in FIG. 3. On the second stroke with the chuck 34 applied to the punch 32 (the chuck itself having an internal nose 38 of the appropriate developed length) and the disc 31 in place, the closing of the outer walls of the collar 27, and also the compression of the disc 31, take place simultaneously to form a sound closed joint.

While a convex closure disc 31 is described in FIGS. 3 and 4, the disc 31 could be flat or concave in alternative embodiments of the invention. In the case of a flat closing disc 31, the sequence as described above for a convex disc 31 is followed exactly, however, the nose 36 of the chuck 43 will not contact the disc.

In the case of a concave disc 31, depending on its inherent stiffness, a support punch coaxial with the tube 25 may be required in order to avoid the disc's collapse under closing pressure.

Knurling 37 is shown provided about chuck 43 to facilitate its handling.

"O" ring 33 of FIG. 5 simply holds the chuck 43 in place on the punch due to the partial vacuum created on application.

It is envisaged that the flange 28 of the collar 27 could be relatively wide so as to extend some distance underneath the plate 28. For example, a width of perhaps 7 mm for the flange 26 may be appropriate for some sizes of tubes.

Although the embodiments above describe a tube end closure, in many instances, only a tube end joint is required.

In a "reactive" type muffler for example, there would be a need for a leak-free torque resistant inside to outside interface joint but not usually an end closure.

Figure 6A:
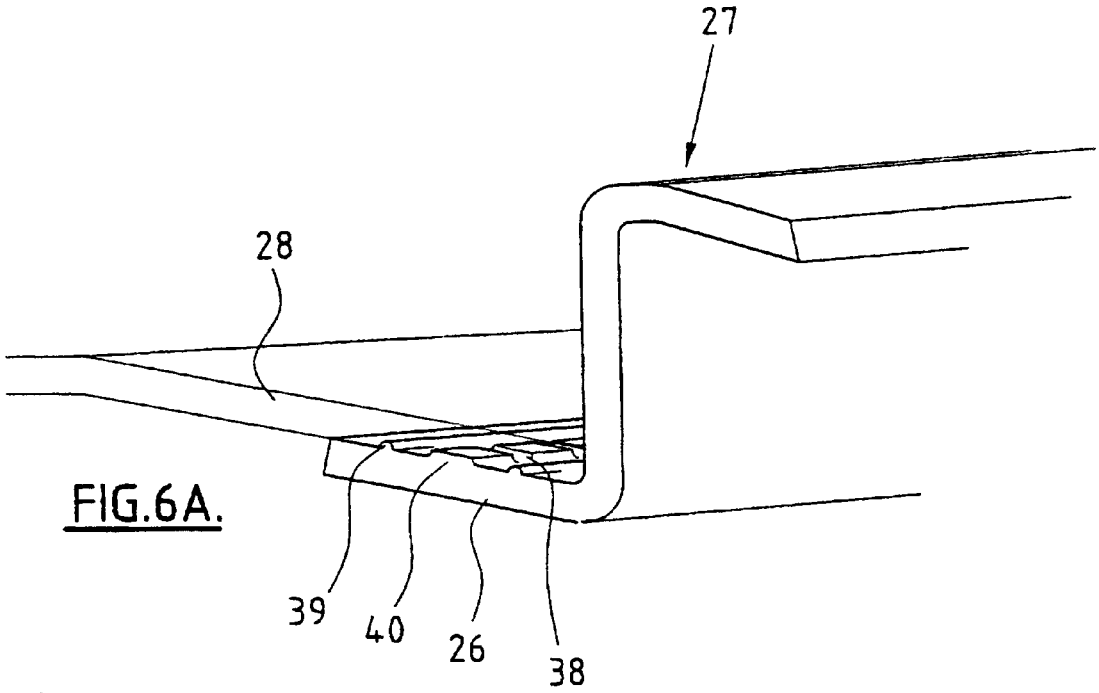
FIGS. 6A, & 6B: show the formation of a tube end joint with a plate, according to a further embodiment of the invention.

In such joints, and/or in the tube end closure, as shown in FIG. 6A, the flange 25 may include primary and secondary sealing ribs 38, 39 respectively. These ribs 38, 39 may be concentric or may be eccentric, in which letter case, the ribs 38, 39 may act as torsion resistance ribs acting so as to enhance the engagement with the under surface of the plate 28. The flange 26 may, however, include a specific one or more torsion resistance ribs 40, such as shown, which may be stepped, straight knurled, diamond knurled, or of any suitable shape or form, in order to enhance the engagement of the flange 26 with the under surface of the plate 28.

Figure 6B:
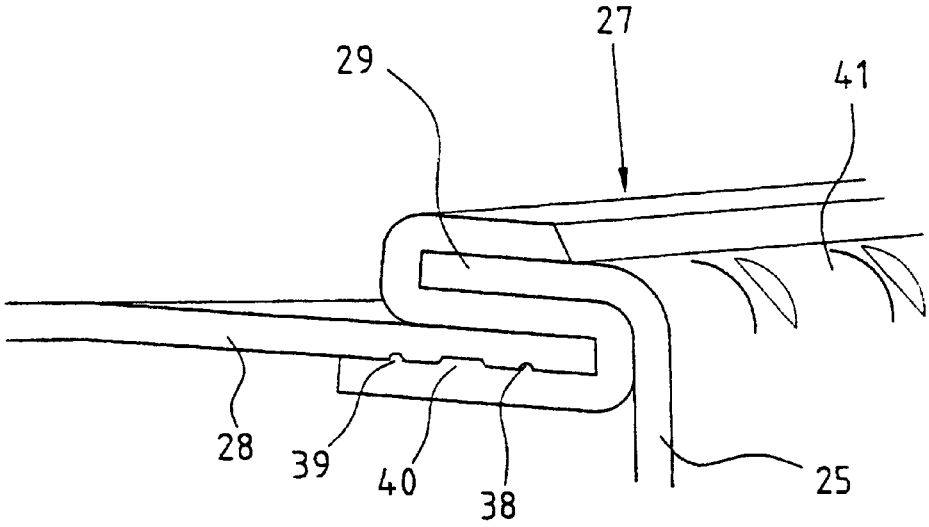
Figure 10:
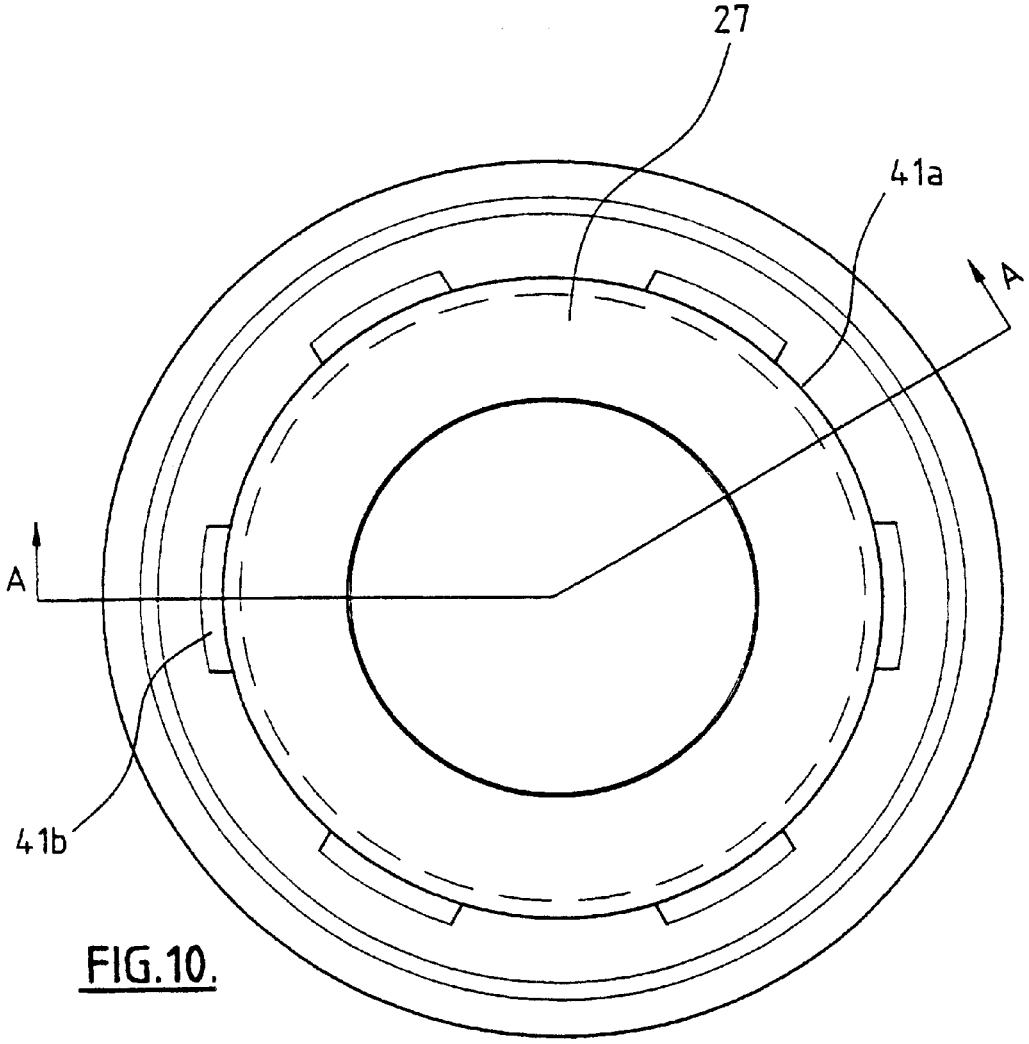
FIG. 10: shows a plan view of the collar of FIG. 7.
Figure 11:
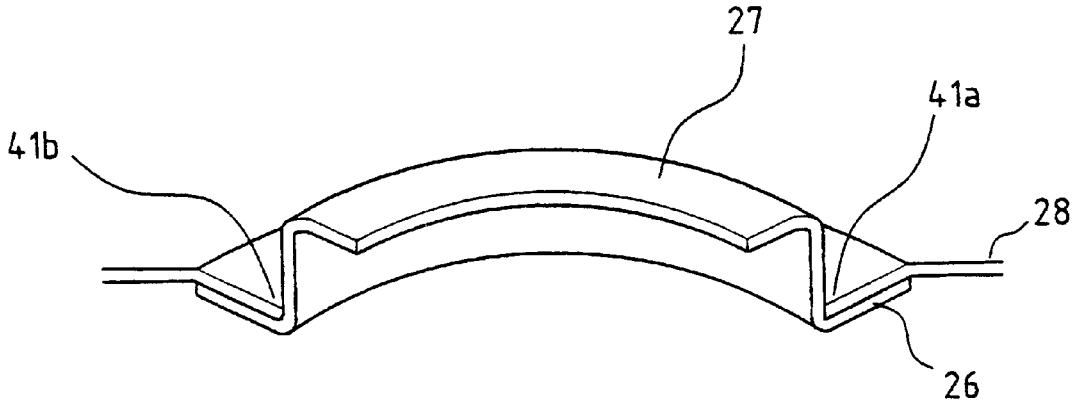
FIG. 11: shows a cross sectional view along arrows A—A of FIG. 19.

In FIG. 6B, the collar 27 is shown forming a joint between the end 29 of the tube 25 and utilising primary and secondary sealing ribs 38, 39 and a torsion resistance rib 40. Additionally, however, a final swaging 41 may be provided for the edge of the tube end 29 which swaging incorporating reinforcing ribs which will eliminate tube memory and enhance the locking of the collar 27 to the tube end 29. As shown particularly in FIG. 6B, the sealing ribs 38, 39 and the torsion rib 40 become embedded in the material of the plate 28 with the forming of the joint therebetween.

It is envisaged that one or more sealing ribs 38 or 39 and one or more torsion resistance ribs 40 may be utilised in a tube end joint in circumstances where a tube end closure is also not required.

Where a tube end closure is not required, merely a joint, then a collar 27 according to any of the embodiments of the invention could be utilised in providing the joint for the tube end 29 secured between the inner edge of the collar 27, the plate 28 then being secured between the outside wall of the collar 27 and the bottom flange 26 of the collar 27.

Referring now to FIGS. 7 to 11, an alternative form of collar 27 may be provided with further locking which provides for enhanced torsional strength at the joint with the free end of the tube 28.

It will be appreciated by those skilled in the engineering arts that as the "hinge point" or the root of the joint is the most resistant to opening, them to improve locking, the coining of the transition of the flange 26 to obtain positive indentations on which the plate 28 is swaged during the clenching operation which result in an improved joint.

Accordingly, the "coining" or indenting of the edge 41, defined by the bottom of the wall of the collar 27 and the flange 26, to different degrees can provide the transitional steps to achieve this, in FIG. 8, a sharp coin 41*a* is provided along part of the rim 41 while a radiused coin 41*b* is provided along other parts of the rim 41. A suitable coining tool 42 is illustrated very diagrammatically in FIG. 9 provided with edge formulations 43, 44 in order to achieve the necessary degrees of coining and a recess 45 to create the rib 40.

It will be appreciated that as the coining changes around the rim 41, it will provide steps or teeth which assist in trapping the plate 28, enhancing resistance to torque and enhancing the joint.

It is, thus, seen that the present invention in its various embodiments enables a strong gas tight, weld free, torsion resisting, joint to be provided for a tube and with particular, but not exclusive, application in the construction of muffler assemblies.

Where in the foregoing description references has been made to specific components or integers of the invention having known equivalents then such equivalents are herein incorporated as if individually set forth.

Although this invention has been described by way of example and with reference to possible embodiments thereof it is to be understood that modifications or improvements may be made thereto without departing from the scope of the invention as defined in the appended claims.

What is claimed is:

1. A muffler assembly having at least one tube for the transmission of exhaust gasses and including a closure for an end of said tube, said tube end closure including a collar member which secures a free end of said tube within an aperture provided in a plate member and a closure means which is secured between an inner edge of said collar member and said free end of said tube and closing off said free end of said tube, and wherein said collar member has a plurality of indentations provided about a peripheral rim thereof which engage with said plate member about said aperture.

2. A collar member for a tube end closure or tube end joint which has a peripheral side wall defining a space within which a free end of a tube can be accommodated, said side wall extending between a flange defining an inner edge, which can be forced inwardly to engage said free end in forming said closure or joint, and a peripheral rim of the collar having radiused and non-radiused coining which define a plurality of indentations in said rim.

3. A tube end closure, including a collar member, said collar member securing a free end of a tube within an aperture provided in a plate member, a closure means secured between an inner edge of said collar member and said free end of said tube to close off said free end of said tube, wherein said collar member has a plurality of indentations provided about a peripheral rim thereof to engage with said plate member about said aperture.

4. A tube end closure as claimed in claim 3, wherein said rim has radiused and non-radiused coining which defines said indentations.

5. A method of forming a tube end closure wherein a collar member is secured within an aperture provided in a plate member, a free end of a tube is positioned to extend through said aperture, a closure means is secured within said free end of said tube and between said collar member and said free end, said method further including providing a peripheral rim of said collar member with a plurality of indentations which engage with said plate member about said aperture.

6. Apparatus for forming a tube end closure for a free end of a tube extending through an aperture in a plate member said apparatus including means to receive a collar member and secure it to said free end and further means to secure a closure means within said free end and positioned between said free end and said collar member and further including means to provide a plurality of indentations about a peripheral rim of the collar member which will engage with said plate member about said aperture.

7. A tube end joint including a collar member, a free end of a tube extending through an aperture in a plate member, said free end accommodated within said collar member, an inner edge of said collar member securing said free end against a wall of said collar member, said aperture defining an edge of said plate member which is secured between said wall and a bottom flange of said collar, and wherein said collar member has a plurality of indentations provided about a peripheral rim thereof which engage with said plate member about said aperture.

* * * * *